United States Patent [19]

Matsuzaki et al.

[11] Patent Number: 4,772,823

[45] Date of Patent: Sep. 20, 1988

[54] MAGNETIC ANODE AND A METHOD OF MANUFACTURING THE SAME

[75] Inventors: Hikaru Matsuzaki, Yokohama; Toshiyuki Matsuzaki; Tatsuo Simizu, both of Kawasaki; Masataka Komine, Yokohama, all of Japan

[73] Assignee: Tokyo Shibaura Denki Kabushiki Kaisha, Kawasaki, Japan

[21] Appl. No.: 332,298

[22] Filed: Dec. 18, 1981

[30] Foreign Application Priority Data

Dec. 26, 1980 [JP] Japan ..... 55-184012

[51] Int. Cl.[4] ..... H01J 25/50

[52] U.S. Cl. ..... 315/39.51; 315/39.69; 315/39.75; 315/5.35

[58] Field of Search ..... 315/39.51, 39.53, 39.75, 315/39.71

[56] References Cited

U.S. PATENT DOCUMENTS

| | | | |
|---|---|---|---|
| 2,305,781 | 12/1942 | Helbig | 315/39.71 X |
| 2,459,195 | 1/1949 | Spencer | 315/39.71 |
| 2,852,720 | 9/1958 | Crapuchettes | 315/39.75 |
| 3,383,551 | 5/1968 | Gerard | 315/39.51 |
| 3,989,979 | 11/1976 | Konno et al. | 315/39.77 |
| 4,063,129 | 12/1977 | Miura et al. | 315/39.71 |
| 4,109,179 | 8/1978 | McKinnon . | |

FOREIGN PATENT DOCUMENTS

| | | |
|---|---|---|
| 0001173 | 3/1979 | European Pat. Off. . |
| 135659 | 11/1977 | Japan . |
| 125565 | 9/1979 | Japan . |
| 455923 | 10/1936 | United Kingdom . |
| 491557 | 9/1938 | United Kingdom . |
| 1158589 | 7/1969 | United Kingdom . |

*Primary Examiner*—David K. Moore
*Assistant Examiner*—Michael Razavi
*Attorney, Agent, or Firm*—Cushman, Darby & Cushman

[57] ABSTRACT

A magnetron anode constructed by welding a pole piece to each open end of a copper anode cylinder. A nickel layer is plated on the surface of the pole piece. A welded mass resulting from welding the pole piece to the open end of the anode cylinder covers the peripheral edge of the pole piece. The welded is mostly formed of a nickel-copper alloy resulting from the mutual fusion of the copper material of the anode cylinder and the nickel of the nickel layer.

20 Claims, 9 Drawing Sheets

FIG. 7
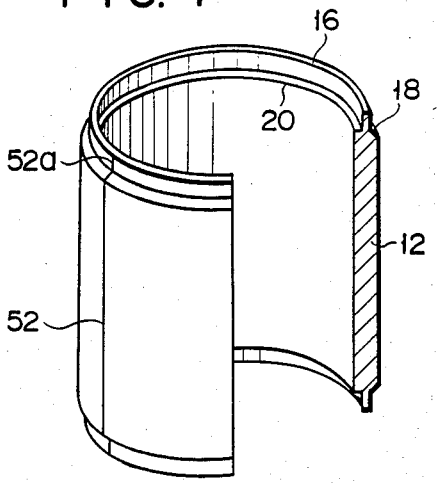
FIG. 8
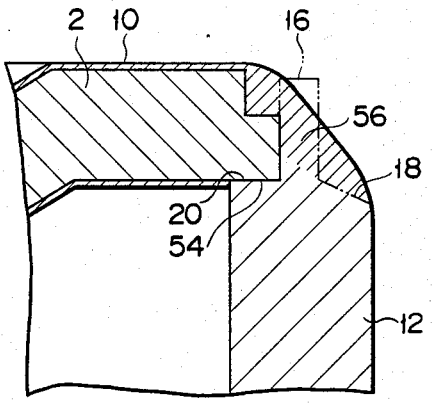
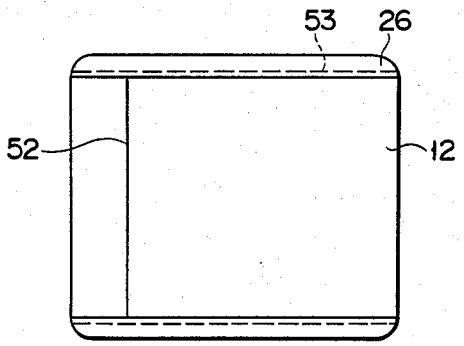
FIG. 9
FIG. 10
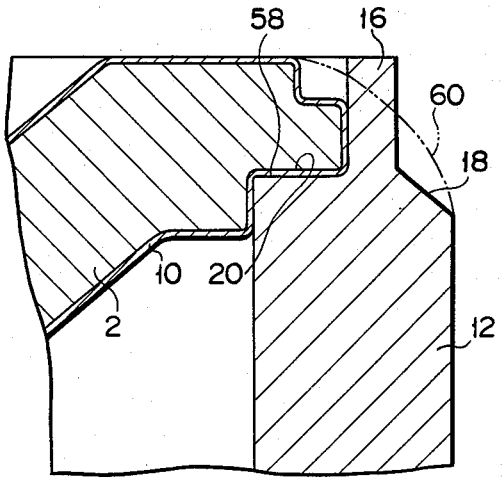
FIG. 11
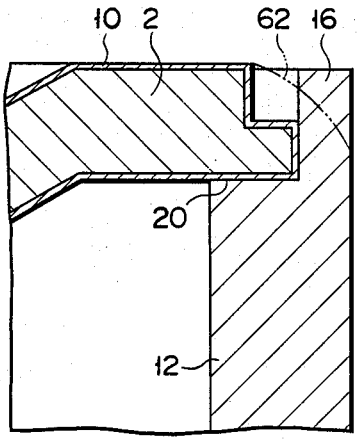

MAGNETIC ANODE AND A METHOD OF MANUFACTURING THE SAME

BACKGROUND OF THE INVENTION

This invention relates to a magnetron anode and a method of manufacturing the magnetron anode, and more particularly to a magnetron anode in which a pole piece is coupled in airtightness to both open ends of an anode cylinder and a method of assuring said structure of the anode.

With a magnetron unit for a microwave oven, a plurality of radially extending anode vanes are generally fitted to the inner peripheral wall of a copper anode cylinder. Resonance cavities are formed between the vanes. Both open ends of the anode cylinder are respectively fitted with a ring-shaped pole piece to conduct a magnetic flux to an interaction space defined in the anode cylinder. Recently, a magnetron anode structure is accepted in which an iron pole piece is connected in airtightness to both open ends of the anode cylinder, and the pole pieces and anode cylinder jointly constitute part of a vacuum envelope. The airtight coupling of the pole pieces to the anode cylinder has hitherto been effected by brazing or arc welding. The process of fixing pole pieces to an anode cylinder in airtightness is already disclosed in the Japanese utility model disclosure (KOKAI) No. 53-87044, Japanese utility model disclosure (KOKAI) No. 51-121164 and Japanese patent disclosure (KOKAI) No. 52-135659. With the welding process proposed in the above-listed disclosed publications, a welding annular groove is formed near both end openings of a copper anode cylinder along the outer peripheral wall thereof. Consequently a thin flange is formed at the both open ends of the copper anode cylinder. A pair of pole pieces are mounted on the flanges. The pole pieces and flanges are welded throughout the periphery of the anode cylinder by an arc welding electrode facing the joint of the paired pole pieces and flanges. It is known that the pole pieces can be welded to the aluminum anode cylinder in the same manner as set forth in the utility model disclosure (KOKAI) No. 54-125565.

With the above-mentioned welding process, the flanges of the anode cylinder and the peripheral edge of the respective pole pieces are welded together into an alloy junction. The alloy junction has a sufficiently airtight structure to enable the pole pieces to both open ends of the anode cylinder. However, the alloy junction has been found to have a low mechanical strength. The reason for this drawback is that an alloy junction formed of copper constituting the anode cylinder and iron constituting the pole piece is brittle. A higher concentration of iron renders the alloy junction more brittle. The above-mentioned known welding process tends to cause iron to be carried into the alloy junction at a higher concentration. With a microwave oven in which the intermittent actuation of a magnetron is carried out extremely often, mechanical stresses and deformation forces resulting from intermittent actuations are concentratedly applied to the welding junction of the copper anode cylinder and iron pole pieces which have different thermal expansion coefficients. As a result, the fragile welded junction is sometimes damaged due to the occurrence of cracks, eventually leading to the failure of the welded junction to preserve airtightness. Where the anode cylinder is made thin, then the welded junction will decrease in thickness, causing the above-mentioned difficulties to appear noticeably. Further, the aforesaid annular groove locally reduces the thickness of the anode cylinder, rendering the welded junction mechanically weak. Further, welding flushes project from the peripheral edge of the pole pieces, causing a magnet or magnetic flux-concentrating board set on the welded junction fail to be fitted to the surface of the pole pieces with sufficient tightness and leading to prominent irregularities in magnetic resistance.

The process of manufacturing an anode cylinder includes the process of cutting a copper tube in a prescribed length to provide the anode cylinder, and the process of folding a copper rectangular plate having a prescribed length into a cylindrical form and brazing the joints in airtightness by an alloy of 72% silver and 28% copper (the Japanese patent disclosure (KOKAI) No. 48-90464, Japanese utility model disclosure (KOKAI) No. 49-11659, Japanese utility model disclosure (KOKAI) No. 49-67545, Japanese utility model disclosure (KOKAI) No. 51-121160 and U.S. Pat. No. 4,163,921). Where pole pieces are welded to the anode cylinder produced by the latter process, then not only the aforesaid difficulties but also the undermentioned drawbacks arise.

Where the pole pieces are arc welded to the flange of the anode cylinder, the resultant heat causes the alloy brazing material applied to the joint of the anode cylinder to flow out along the annular groove, the inner wall and the joint of the anode cylinder, giving rise to the possibility of the airtightness of the joints being broken. Further, an anode cylinder constructed by folding, for example, a copper plate into the cylindrical form and brazing the joint of the folded plate has the drawback that even where the pole pieces are welded to the anode cylinder in a manner to bypass the brazed joints, still the brazed material is locally melted away, and consequently where part of the annular groove is formed in the brazed section of the joints of the anode cylinder, then the brazing material is concentratedly collected in the groove by its surface tension, resulting in the incomplete brazing of the joint of the anode cylinder. Where the pole pieces are welded to the anode cylinder, the brazing material sometimes locally boils by welding heat with the formation of air bubbles. To eliminate the occurrence of the above-mentioned difficulties, it is necessary to increase the thickness of the anode cylinder and weld pole pieces to the anode cylinder with utmost care. From the above-mentioned standpoint, it is strongly demanded to establish a method of manufacturing a magnetron anode adapted for quantity production and characterized by high reliability and sufficient mechanical strength.

SUMMARY OF THE INVENTION

It is accordingly the object of this invention to provide a magnetron anode whose welded portion has a great mechanical strength and a high airtightness and a method of manufacturing said magnetron anode.

To attain the above-mentioned object, this invention provides a magnetron anode in which a pair of covers are respectively welded to both open ends of an anode cylinder of copper or an alloy thereof, and also a method of manufacturing the magnetron anode, which comprises the steps of plating at least the outer peripheral edge of the cover with metal readily alloyable with the copper, and welding the plated covers to both openings of the anode cylinder in such a manner that the molten metal covers the outer peripheral edges of the covers, thereby enabling the welded portion formed of a copper-metal alloy to have a high airtightness and great mechanical strength.

BRIEF DESCRIPTION OF THE DRAWING

FIG. 7 is an oblique exploded view of an anode cylinder used with a magnetron anode according to another embodiment of the invention;

FIG. 8 is a partial cross sectional view of a pole piece welded to the anode cylinder of FIG. 7;

FIG. 9 is a front view of a magnetron anode constructed by welding pole pieces to the anode cylinder of FIG. 7;

FIGS. 10 to 13 show the various patterns of the welded portion of the magnetron anodes;

DETAILED DESCTIPTION OF THE PREFERRED EMBODIMENTS

Figure 1:
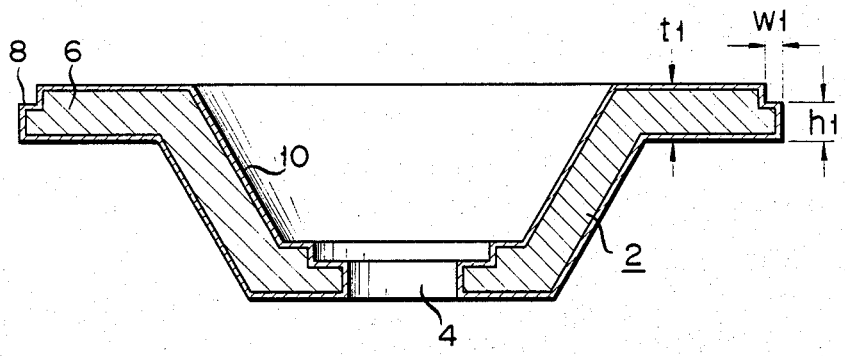
FIG. 1 is a cross sectional view of a pole piece used with a magnetron anode embodying this invention.
Figure 2:
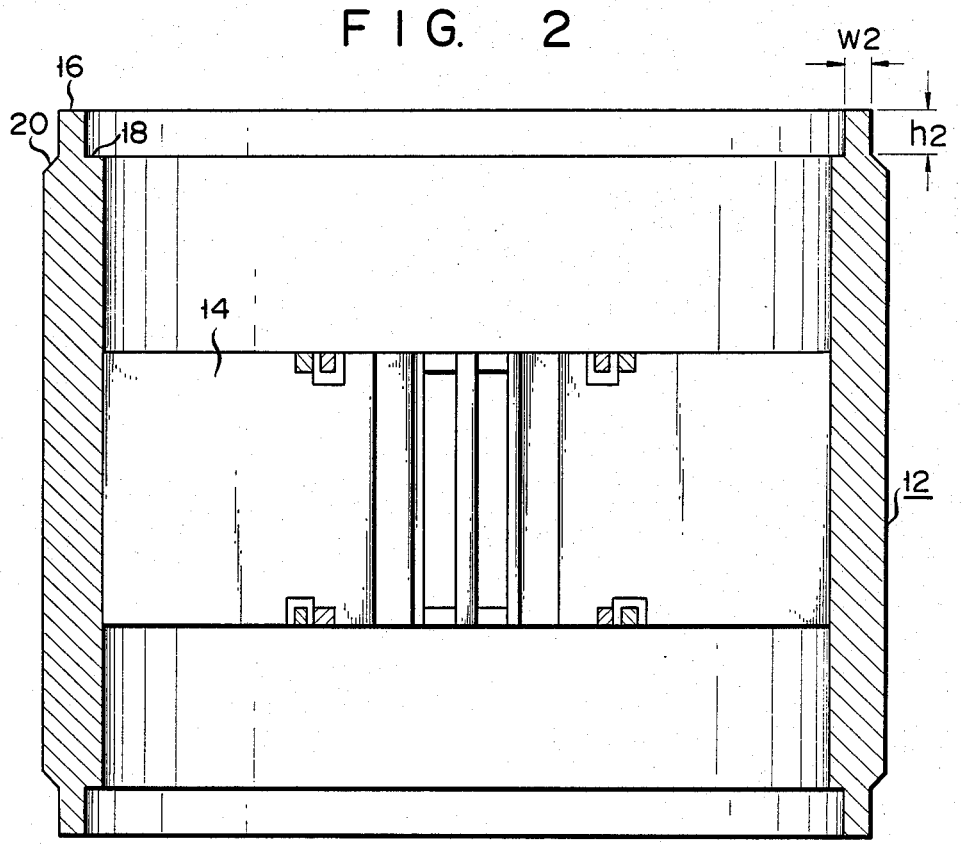
FIG. 2 is a cross sectional view of an anode cylinder used with a magnetron anode according to one embodiment of this invention.

A pair of pole pieces are each constructed by pressing an iron disc into a dish shape shown in FIG. 1. A hole 4 is punched in the bottom of the dish. A stepped portion 8 is formed all along the surface of the outer peripheral edge of a flange 6 of the pole piece 2. According to the embodiment of FIG. 1, a nickel layer 10 is plated on at least the whole outer peripheral edge of the flange 6 of the pole piece with a thickness of 2 to 20 microns or preferably 5 to 10 microns. The plated layer 10 may be formed of not only nickel, but also copper or any other metal readily alloyable with the copper constituting an anode cylinder 12.

A plurality of radially extending vanes 14 are fixed to the inner wall of the anode cylinder 12, to both open ends of which the pole piece 2 of FIG. 1 is welded. A resonance cavity is defined between the respective vanes 14. The outer and inner peripheral edges of each of both open ends of the anode cylinder 12 are partly cut off to provide an annular projection 16 which defines inner and outer shoulders 18, 20 respectively on the inner and outer peripheral planes of each of both openings of the anode cylinder 12. The annular projection 16 is chosen to have an inner diameter substantially equal to or slightly larger than the outer diameter of the pole piece 2.

With a magnetron having an oscillation frequency of 2,450 MHz and producing a power of several hundred watts, the preferred dimensions of the magnetron anode of the invention are prescribed as follows:

| | mm |
|---|---|
| Thickness (tl) of the plate of the pole piece 2 | 1.6 |
| Width (wl) of the stepped portion of the outer peripheral edge of the flange 6 | 0.3 |
| Height (hl) of said stepped portion | 0.7 |
| Thickness (t2) of the anode cylinder 12 | 2.5 |
| Height (h2) of the projection 16 | 1.3 |
| Width (w2) of said projection 16 | 0.6 |

The pole piece 2 is prepared from a ferromagnetic material such as iron or an alloy containing iron. As used herein, the pole piece 2 is simply referred to as "an iron pole piece". The anode cylinder is prepared from copper or an alloy mainly consisting of copper. As used herein, the anode cylinder is simply referred to as "a copper anode cylinder".

Figure 3:
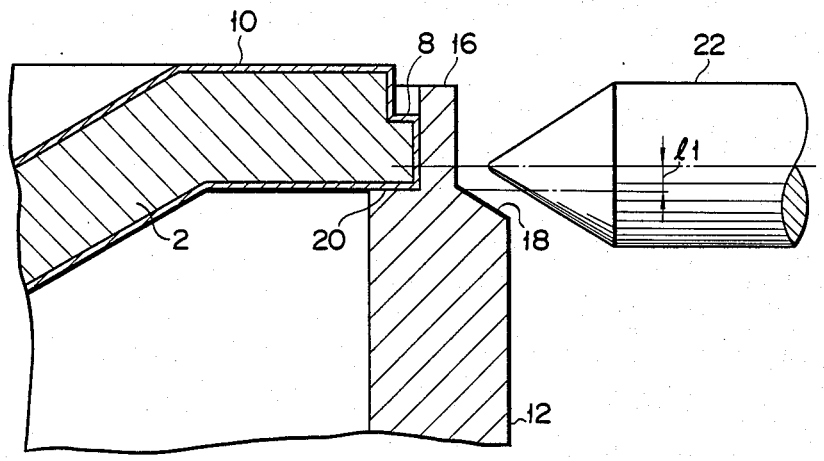
FIG. 3 is a cross sectional view of part of a pole piece of FIG. 1 fitted to the open end of the anode cylinder of FIG. 2 in a state ready for welding.

As shown in FIG. 3, the pole piece 2 is mounted on the inner shoulder 18 of the open end of the anode cylinder 12 to be pressed against the inner wall of the projection 16. The pole piece 2 thus positioned is arc welded to said open end by means of a welding electrode 22 in an atmosphere of inert gas. In this case, the welding electrode 22 is made to face the projection 16 of the anode cylinder 12. The pointed end of the welding electrode 22 is set at a point measuring about one-fourth of the height (h1) of the stepped portion of the outer end of the pole piece 2 as measured from the bottom end of the outer peripheral edge of the pole piece 2. A measurement l1 accounts for about one-fourth of the height (h1) of the stepped portion. The cylindrical projection 16 of the anode cylinder 12 is so arranged as to be interposed between the welding electrode 22 and the outer peripheral wall of the pole piece 2, thereby preventing an arc from being produced between the pole piece and the pointed end of the welding electrode 22. Namely, an arc discharge takes place between the welding electrode 22 and anode cylinder 12, thereby preventing an arc discharge from being generated between the welding electrode 22 and pole piece 2.

With the above-mentioned arrangement, while the anode cylinder 12 makes a one and three-tenths rotation, the anode cylinder 12 and pole piece 2 are arc welded together. As a result, the iron pole piece 2 is shielded by the projection 16 of the anode cylinder 12 and is prevented from being directly melted by an arc. In other words, mainly the nickel layer 10 plated on the surface of the pole piece 2 and the copper of the projection 16 of the anode cylinder 12 are welded together, or if the nickel layer 10 was brazed by molten copper, thereby producing a sufficiently airtight welded state.

Figure 4:
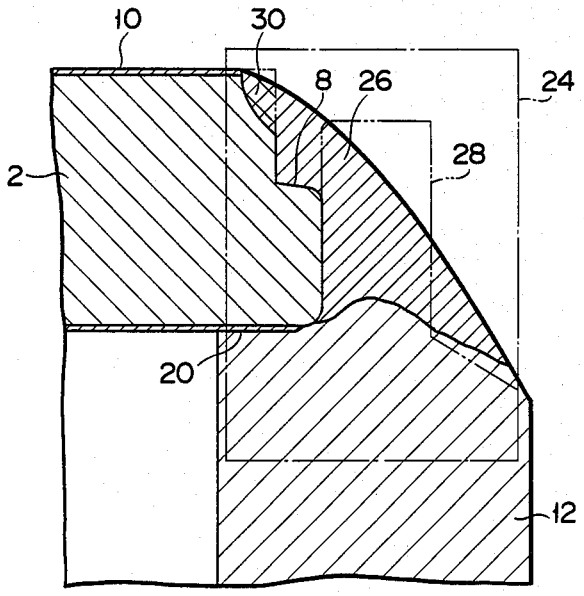
FIG. 4 is a cross sectional view of part of the welded mass of the assembly of FIG. 3.
Figure 5:
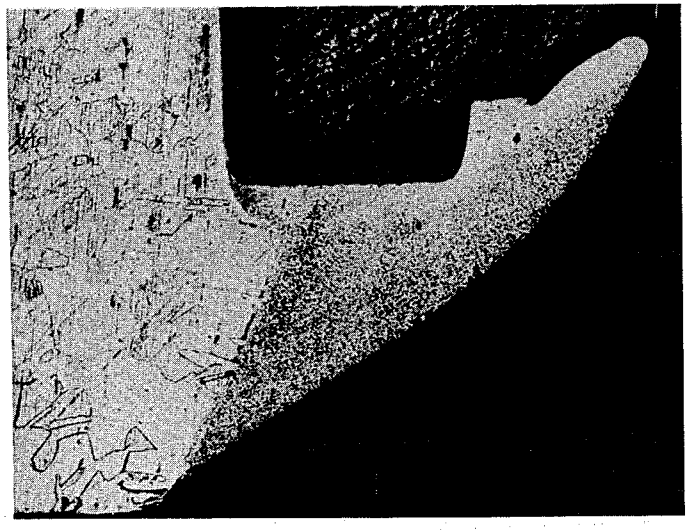
FIG. 5 is a photograph of a one dot-dash region shown in FIG. 4.

As seen from FIG. 4 and FIG. 5 indicating a photograph of a region enclosed in one dot-dash lines, the outer peripheral wall of the pole piece 2 retains substantially the same form as the original. In other words, the proximiry of the outer peripheral wall of the pole piece 2 is covered with a copper-nickel welded alloy, namely, a eutectic mass 26 (incidated in a hatching in FIG. 4). Said eutectic mass 26 is tightly attached to the surface of the stepped portion 8 and further extends to the outer peripheral wall of the anode cylinder 12 in the form of a gently curved slope. A copper-nickel-iron alloy produced by the slight melting of the iron of the pole piece into the welded copper-nickel alloy is deposited on the surface of the pole piece 2 as shown by numeral 30 (FIG. 4). Broken lines 28 (FIG. 4) denotes the original shape and position of the projection 16 of the anode cylinder 12, showing that the welded alloy mainly consists of the copper of said projection 16 and the nickel of said nickel layer 10.

The welded alloy of the magnetron anode embodying this invention is deposited on the pole piece 2 which retains substantially the same form as the original. Therefore, the iron content of said welded alloy is considerably small. In other words, the proximity of the outer wall of the pole piece 2 is almost wholly constituted by a dendritic metal structure resulting from the mutual melting of the copper of the anode cylinder 12 and the nickel of the nickel layer 10 coated on the surface of the pole piece 2, thereby providing a magnetron electrode which is prevented from getting brittle and welded in airtightness with a sufficiently great mechanical strength. The magnetron anode of this invention has further advantages that the portion of said magnetron anode which extends from the bottom corner of the outer peripheral wall of the pole piece 2 to the outer surface of the welded mass exposed to the atmosphere is made with a sufficiently great thickness, enabling the magnetron anode to fully withstand the expansion an contraction caused by its intermittent actuation.

The atmosphere in which the arc welding is carried out should advisably be formed of an inert gas such as helium, argon or nitrogen. More preferred is an atmosphere which is formed by adding less than 10% by volume or preferably 3 to 8% by volume of a reducing gas such as hydrogen to the aforementioned inert gas. The addition of said reducing gas is for the reason that a large volume of gas is released from the materials of the anode cylinder 12 and pole piece 2, and consequently application of said reducing gas prevents the surface of the welded mass and the inner wall of the anode cylinder 12 from being oxidized. Application of pulse current causes arc welding to be accompanied with sudden heating and cooling, tending to give rise to cracks in the welded mass. In contrast, it has been discovered that direct current arc welding is more adapted for the airtight welding of the iron pole piece 2 to the copper anode cylinder 12. Namely, application of direct current arc welding is more desired, because a dendritic crystal structure does not appear in the welded mass, providing a crystalline structure free from the growth of said dendritic crystalline structure and the orientation of crystals.

Figure 6:
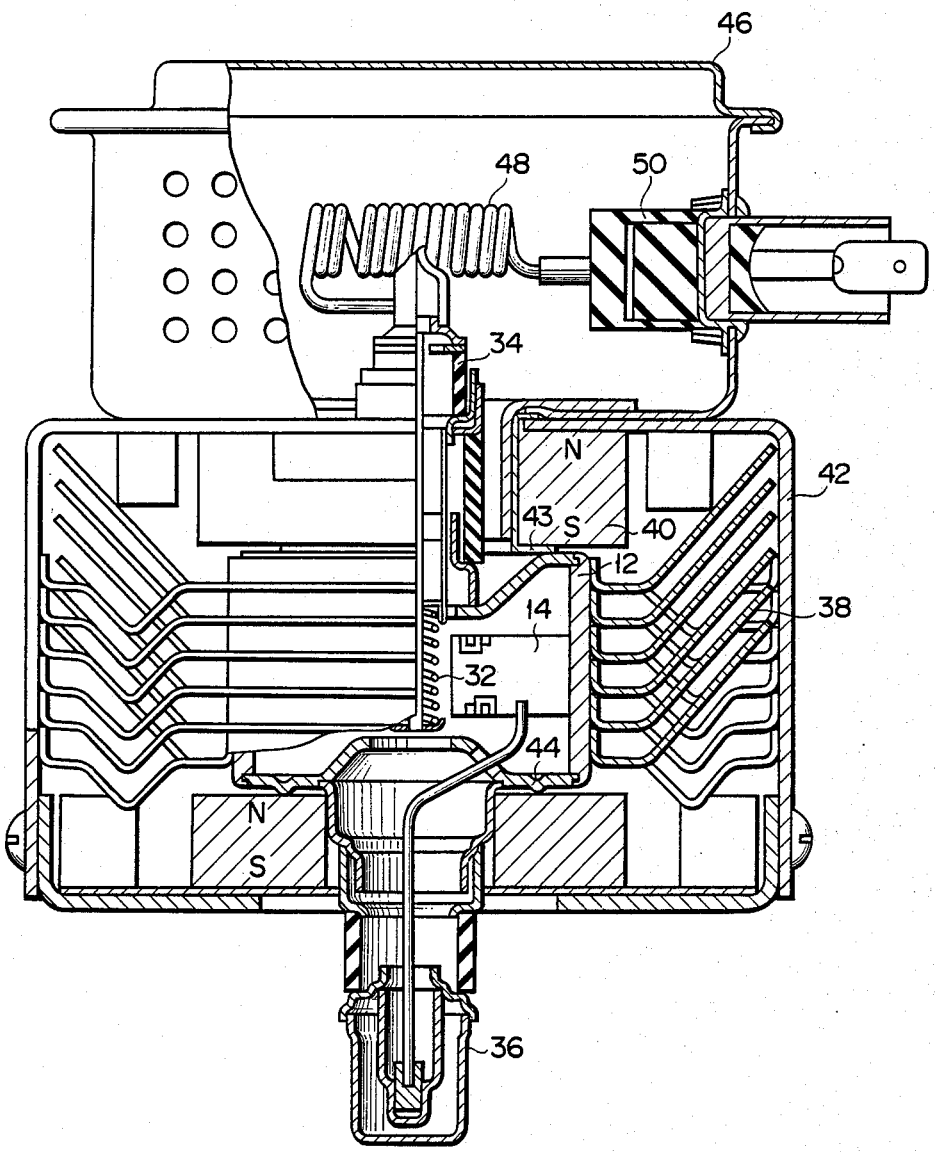
FIG. 6 is a partial cross sectional view of a magnetron unit provided with the magnetron anode of the invention.

A magnetron anode constructed by welding a pole piece 2 to each open end of the anode cylinder 12 in airtightness is assembled with other members to constitute a magnetron unit as shown in FIG. 6. A cathode 32 is provided in a state extending along the axis of the anode cylinder 12. A cathode stem 34 for supporting the cathode 32 is mounted on one of the paired pole pieces 2. The other pole piece 2 is fitted with an output section 36 which comprises an antenna lead connected to a plurality of vanes to radiate microwaves. A plurality of cooling fins 38 are fitted to the outer peripheral wall of the anode cylinder 12 to cool it when it is pressed into a radiator assembly. A ferrite permanent magnet 40 is magnetically coupled to the pole piece 2 to supply magnetic energy thereto. The permanent magnet 40 is magnetically coupled to a ferromagnetic yoke 42 and clamped between the yoke 42 and pole piece 2. One pole piece 2 is magnetically coupled to the permanent magnet 40 by means of a flange of a sealed cylinder 43. A projection 44 is provided on the surface of the other pole piece 2. Said other pole piece 2 is magnetically coupled to the yoke 42 in point contact. A gap is provided between the other pole piece 2 and yoke 42. The cathode stem 34 is held in a magnetic shield box 46 to be electrically connected to a choke coil 48 and penetrating capacitor 50.

The magnetron anode included in the above-mentioned magnetron unit is free from any projection which right obstruct the fitting radiator fins to the outer peripheral wall of the anode cylinder 23 or the mounting of a permanent magnet on the surface of the pole piece 2, presenting no difficulties in assembling a magnetron unit.

This invention is applicable to an anode cylinder by folding a flat plate and brazing the joint of the folded flat plate. As seen from FIG. 7, an anode electrode 2 constructed by folding a flat copper plate (not shown) in the cylindrical form and brazing the joint of the folded plate has a brazed section 52 extending in parallel with the axis of the folded cylinder (or obliquely in the circumferential direction thereof). An annular projection 16 is formed, as shown in FIG. 7, by cutting off part of the open end of said cylinder all along the peripheral edge thereof or elastically deforming part of same peripheral edge. The pole piece 2 is fabricated as illustrated in FIG. 1. A nickel layer is plated on the surface of the pole piece 2. The pole piece 2 is fitted to the anode cylinder 12. Both members are arc welded together as shown in FIG. 3. In this case, the brazed section 52 is welded under the same condition as that in which the other sections are welded. It is preferred to start welding at a point other than the brazed section 52 in order to assure the uniform welding of said brazed section 52.

The above-mentioned process provides a welded junction 26 covering the outer peripheral wall of the pole piece 2. That portion of said welded junction 26 which is close to the pole piece 2 is mainly formed of a copper-nickel alloy, and the other portions are formed of copper. That portion of the welded junction 26 which lies on the brazed section 52 of the anode cylinder 12 locally contains a copper-silver-nickel alloy which has a sufficiently stable crystalline structure. What deserves notice in this case is the discovery that the joint of the folded plate of the anode cylinder can be fully brazed preferably by applying a brazing material containing less than 70% by weight of silver. Generally, electron tubes are joined together by a brazing material formed of a 72% silver- 28% copper. The reason for this is that a eutectic point is assured by said alloy composition. Where, however, an iron pole piece 2 is arc welded to the copper anode cylinder 12 whose joint is brazed by the brazing material, then the brazing material tends to boil. Where, however, an alloy-brazing material containing less than 70% by weight (for example, 50% by weight) of silver is applied, then the brazing material is little likely to boil, rendering the brazed portion so satisfactorily welded as to be hardly distinguishable from other portions of the welded joint. This is perhaps because in the welded section, an eutectic point arises at a relatively high temperature level during welding due to the small content of silver in the brazing material, and before boiling, the silver is diffused in the copper material of the anode cylinder 12, so as later described, flows to the joint between the pole piece 2 and the anode cylinder 12, is more reduced in the content and consequently is prevented from boiling.

The brazing material held in the brazed section 52*a* of the annular projection 16 of the anode cylinder 12 flows during arc welding to the joint between the pole piece 2 and anode cylinder 12, and particularly to a gap 54 (FIG. 8) formed in the joint between the bottom corner of the outer peripheral wall of the pole piece and the inner shoulder 20 of the anode cylinder 12 or to the proximity of said gap 54. As a result, the brazing material is deposited on the above-mentioned spots or a layer of the brazing material is formed thereon. This event contributes to a satisfactory airtight mechanical joint between the pole piece 2 and anode cylinder 12 throughout the periphery thereof. In other words, the above-mentioned flow of the brazing material effects the unexpected favorable function of reinforcing the airtightness of the arc welded pole piece 2 and anode cylinder 12. A broken line 53 given in FIG. 9 defines a region contacted by a brazing material. If, in this case, the brazing material contains less than 70% by weight of silver, then the brazing material of the brazed section 52 will fail to flow out (due to, for example, the aforementioned boiling of the brazing material itself), thereby preventing the depletion of the brazing material of the brazed section 52. Further where, the joint of the folded anode cylinder plate is brazed by a slightly larger amount of brazing material than generally used, or a narrow ring form of brazing material is placed in the aforesaid gap 54 before the arc welding of the pole piece 2 to the anode cylinder 12, then said arc welding can be effected in airtightness throughout the periphery of the pole piece 2 and anode cylinder 12, carrying out the brazing at the same time.

Description is now given with reference to FIG. 10 of a first modification of the arc welding of the pole piece 2 to the anode cylinder 12. A stepped portion 58 is formed at the bottom of the outer peripheral wall of the pole piece 2 in a state fitted into the open end of the anode cylinder 12. In this case, too, an arc welded mass covers the outer peripheral wall of the pole piece 2 as indicated in a broken line 60. Where the anode cylinder 12 is constructed by folding a flat plate in the annular form as shown in FIG. 7 and brazing the mutually facing end portions of said molded plate, then the modified process of FIG. 10 enables part of the brazing material to be deposited in said stepped portion 58, too, thereby assuring a more reliable airtight arc welding of the pole piece 2 to the anode cylinder 12.

Description is now given with reference to FIG. 11 of a second modification of the arc welding of the pole piece 2 to the anode cylinder 12. The open end of the anode cylinder 12 is not provided witn an outer shoulder. The annular projection 16 is integrally formed with the outermost peripheral wall of the anode cylinder 12. In this case, an arc welded mass is produced in the form indicated in a broken line 62. Particularly with the modification of FIG. 11, the anode cylinder 12 having a simple construction can be easily manufactured.

Figure 12:
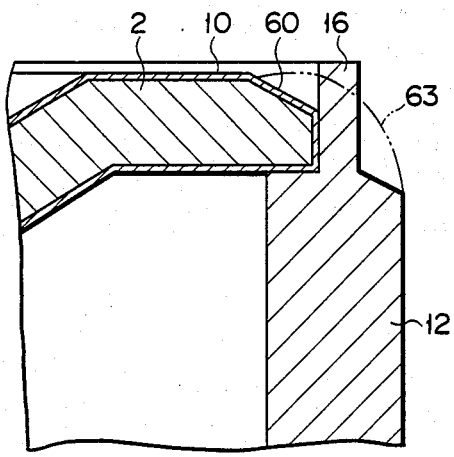

Description is now given with reference to FIG. 12 of a third modification of said arc welding. A tapered plane 60 is formed on the surface of the outer peripheral wall of the pole piece 2. This tapered plane 60 has the same action as the surface of the stepped portion 8 shown in FIG. 3. Said tapered plane is covered with the molten copper material of the anode cylinder 12, providing an airtight arc welded portion having a sufficiently great mechanical strength as indicated in a broken line. With the modification of FIG. 12, the pole piece 2 whose outer peripheral wall has a simple structure can be easily fabricated by press.

Figure 13:
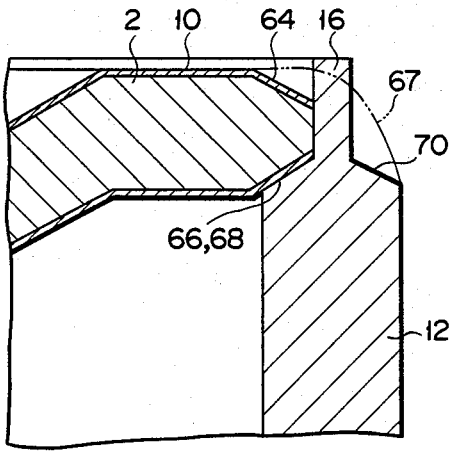

Description is now given with reference to FIG. 13 of a fourth modification of said arc welding. Tapered planes 64, 66 are respectively formed on the top and bottom planes of the outer peripheral wall of the pole piece 2. Tapered shoulder portions 68, 70 are respectively formed on the inside and outside of the open end of the anode cylinder 12 The inner tapered shoulder 68 has such a measurement and an angle of inclination to match the bottom tapered plane of the pole piece 2. Therefore, it is possible to manufacture the pole piece 2 and arc weld the pole piece 2 to the anode cylinder 12 reliably in airtightness as in the preceding modifications.

Figure 14:
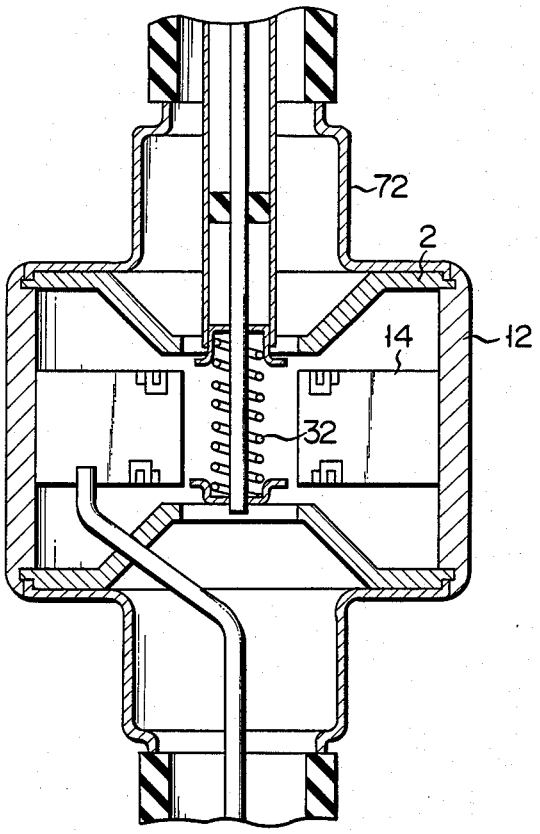
FIG. 14 is a cross sectional view of a magnetron anode according to another embodiment of this invention.

Magnetron anodes according to other embodiments of the invention will now be described with reference to FIGS. 14 to 22. In the magnetron anodes of FIGS. 1 to 13 only the pole piece 2 is welded directly to the opening of the anode cylinder 12 in airtight fashion. By contrast, in the magnetron anode shown in FIG. 14 not only a pole piece 2 but a cylindrical housing 72 is welded to the opening of an anode cylinder 12 in airtight fashion. More specifically, the cylindrical housing 72, not the pole piece 2, constitutes a portion of a vacuum envelope, is made of a ferromagnetic material and functions as a path of a magnetic flux from a magnet (not shown). The magnetron anode of FIG. 14 is manufactured in the following manner.

Figure 15:
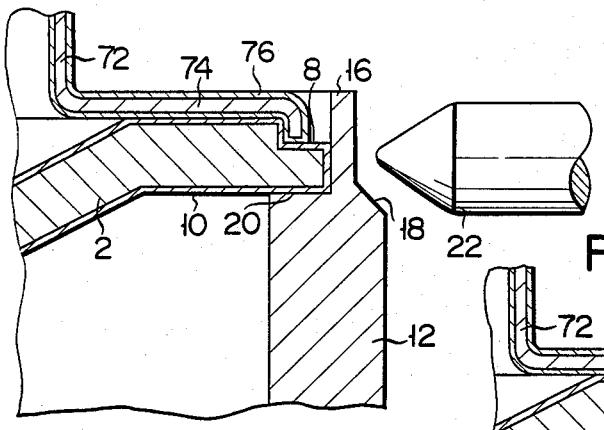
FIG. 15 is a cross sectional view of parts of a pole piece and a cylindrical housing fitted to the open end of the anode cylinder in a state ready for welding.
Figure 16:
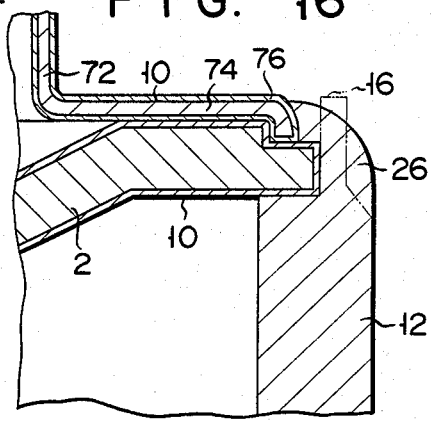
FIG. 16 is a cross sectional view of part of the welded mass of the assembly of FIG. 15.

As shown in FIG. 15, the pole piece 2 is fitted into the opening of the anode cylinder 12, thus bringing the outer periphery of the pole piece 2 into full contact with the projection 16 and inner shoulder 20 of the anode cylinder 12. The projection of the cylinder 12 and the stepped portion 8 of the pole piece 2 define a recess. In the recess there is disposed the bent peripheral portion of the flange 74 of the cylindrical housing 72. The pole piece 2 and the cylindrical housing 72 are plated with metal layers 10 and 76, 5 to 10 $\mu$m thick. The layers 10 and 76 are made of a metal such as nickel, silver or the like, which is much alloyable with copper, i.e. the material of the anode cylinder 12. They may be made of copper, of course. As shown in FIG. 16, heat is applied from an welding electrode 22 to the pole piece 2, projection 16 and cylindrical housing 72 until these members are welded together. Once the pole piece 2, projection 16 and housing 72 are fully welded, the pole piece 2 and the housing 72 are strongly and firmly secured in the opening of the anode cylinder 12 in airtight fashion.

Figure 17:
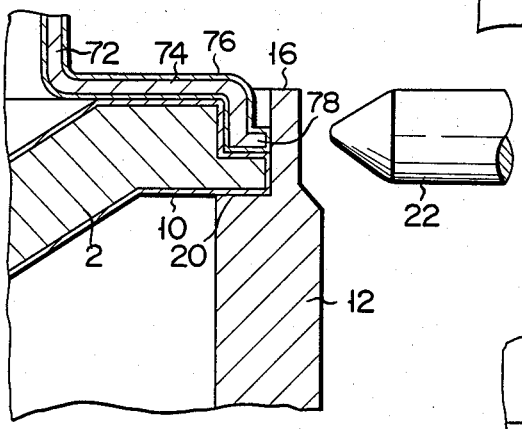
FIGS. 17 to 22 show the various patterns of the welded portions of the magnetron anode according to other embodiment of this invention.
Figure 18:
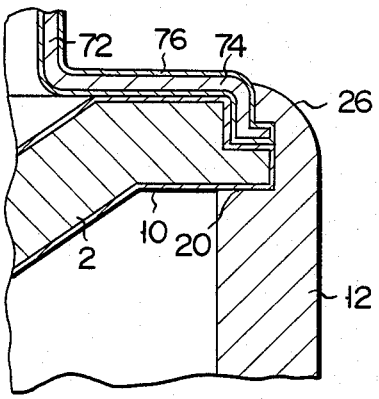

To fix the piece 2 and the housing 72 more firmly in the opening of the anode cylinder 12, the peripheral portion of the flange 74 is bent in the form of letter L and the portion 78 thus bent is disposed in the recess defined by the stepped portion 8 and the projection 16, as illustrated in FIG. 17. As shown in FIG. 18, the peripheral portion of the flange 74 is covered by the projection 16 once the piece 2, projection 16 and the housing 72 have been welded together. Hence, the welded joint have an improved mechanical strength and an improved airtightness.

Figure 19:
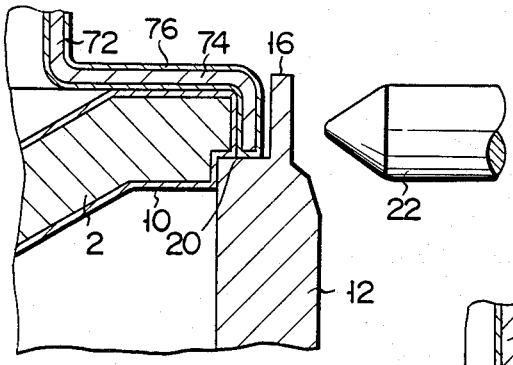
Figure 20:
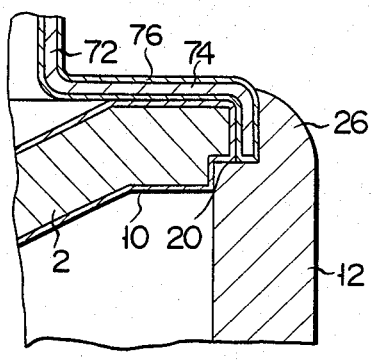
Figure 21:
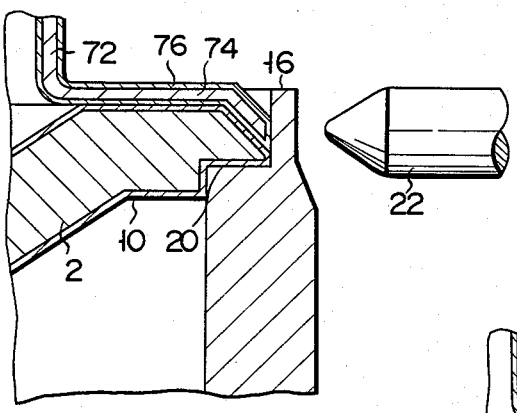
Figure 22:
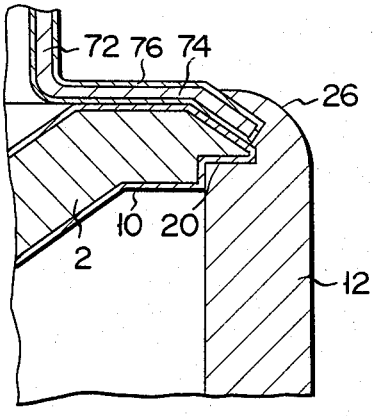

Obviously, the peripheral portion of the pole piece 2 may be shaped in different manners. So may be the peripheral portion of the cylindrical housing 72. For instance, as shown in FIG. 19, the pole piece 2 may have an outer diameter smaller than that of the opening defined by the projection 16 and may thus not be fitted in this opening. If this is the case, the peripheral portion of the flange 74 lies along the periphery of the pole piece 2. Thus, as FIG. 20 shows, the peripheral portion of the flange 74 is covered by the projection 16 once the piece 2, projection 16 and housing 72 have been welded. Further, as shown in FIG. 21, the peripheral portion of the pole piece 2 may be tapered, and, as shown in FIG. 22, the peripheral portion of the flange 74 may be covered by the projection 16 after the piece 2, projection 16 and housing 72 have been welded together.

In the embodiments of FIGS. 14 to 22, the cylindrical housing 72 is connected to the anode cylinder 12 in airtight fashion. At least the peripheral portion of the cylindrical housing 72 is plated with a layer of nickel or the like, which is much alloyable with copper. If the pole piece 2 does not constitute a portion of vacuum envelope, it need not be placed with a layer of a metal such as nickel. But it is preferred that the pole pieced 2 be plated so that it may not corrode during the assembling of the magnetron. Copper is the most preferred material for such an anticorrosion layer because it has a good high frequency conductivity and is relatively inexpensive. Needless to say, the cylindrical housing 72 shown in FIGS. 14 to 22 can be connected in airtight fashion with the above-mentioned anode cylinder which is made by folding a flat plate and brazing the joint of the folded flat plate.

The pole piece and anode cylinder used in the modifications can be assembled together by fabricating them in the proper shape. In such cases, it is advised that a nickel layer be plated on at least that portion of the outer peripheral wall of the pole piece 2 which should be arc welded to the anode cylinder 12. At present, the anode member generally has a hollow cylindrical form having a round cross section. However, this invention is applicable to any other hollow anode member having a rectangular or elliptic cross section. Application of the structure of a magnetron anode embodying this invention to only one of both open ends of the hollow anode member is obviously included in the scope of the invention. Further, the technique of welding is not limited to the arc welding. Obviously, it is possible to apply any other form of welding technique, for example, that which involves the use of a welding rod.

What we claim is:

1. A magnetron anode comprising:

an anode cylinder prepared from a copper-containing metal and having at least one open end, the inner wall of which is provided with a shoulder;

a plurality of radially extending vanes which are fixed to the inner surface of the anode cylinder and between which a resonance cavity is defined; and a pole piece constructed of a material selected from the group consisting of iron and iron-containing alloys, said pole piece having a diameter smaller than the diameter of the open end of the anode cylinder and fitted to the open end of the anode cylinder, at least the outer peripheral surface of the pole piece being plated with a layer which is a metal readily alloyable with copper, the outer peripheral edge of the pole piece being mounted on the shoulder and the open end of the anode cylinder being welded to the outer peripheral edge of the pole piece in an airtight fashion in such a manner that the welded mass covers the outer peripheral edge of the pole piece thereby defining a region in which the pole piece is welded to cylindrical housing.

2. The magnetron anode according to claim 1, wherein the plated layer is nickel and the welded mass is formed of a nickel-copper alloy which results from the alloying of the nickel plated layer with the copper material of the anode cylinder.

3. The magnetron anode according to claim 1, wherein the plated layer is silver and the welded mass is formed of a silver-copper alloy which results from the alloying of the silver plated layer with the copper material of the anode cylinder.

4. The magnetron anode according to claim 1, wherein the anode cylinder is prepared from at least one selected from the group consisting of copper and copper-containing alloys.

5. The magnetron anode according to claim 1, wherein the anode cylinder is constructed by folding a flat plate containing copper into a hollow cylindrical form; and the joint of the mutually facing ends of said folded plate is brazed.

6. The magnetron anode according to claim 5, wherein the brazing material is an alloy containing less than 70% by weight of silver.

7. The magnetron anode according to claim 5, wherein the braging material seeps into the region in which the pole piece is welded to the anode cylinder.

8. The magnetron anode according to claim 5, wherein the outer peripheral edge of the sale piece is provided with a stepped protion which is covered with part of the welded mass.

9. A method of manufacturing a magnetron anode which comprises the steps of:

providing an anode cylinder having two open ends prepared from a copper-containing metal;

providing a pair of covers, at least the peripheral edge of each therefore is plated with a layer which is a metal readily alloyable with the copper;

fitting a cover to each open end of the anode cylinder;

setting an arc electrode at a point facing the peripheral edge of the anode cylinder fitted with the cover; and arc welding each cover to respective open end of the anode cylinder in airtightness.

10. The method according to claim 9, which comprises the steps of:

folding a flat metal plate containing copper into the hollow cylindrical form to provide the anode cylinder; and brazing the mutually facing ends of the folded flat metal plate with a metal.

11. The method according to claim 10, wherein the brazing material is an alloy containing less than 70% by weight of silver.

12. The method according to claim 9, wherein the step of constructing the anode cylinder comprises the step of forming a shoulder on the inner wall of the open end of the anode cylinder, said shoulder being contacted with the peripheral edge of the cover when it is fitted to the open end of the anode cylinder.

13. The method according to claim 9, wherein an atmosphere in which the arc welding is carried out is formed of an inert gas containing less than 10% by volume of hydrogen.

14. A magnetron anode cylinder comprising:

an anode cylinder prepared from a copper-containing metal and having at least one open end, the inner wall of which is provided with a shoulder;

a plurality of radially extending vanes which are fixed to the inner surface of the anode cylinder and between which a resonance cavity is defined;

a pole piece fitted to the open end of the anode cylinder, the outer peripheral edge of the pole piece being mounted on the shoulder;

a cylindrical housing having a flange prepared from a material selected from the group consisting of iron and iron-containing alloys and fitted to the open end of the anode cylinder and mounted on the outer peripheral edge of the pole piece, said flange having a diameter smaller than that of the open end of the anode cylinder at least the peripheral outer surface of the flange being plated with a layer which is a metal readily alloyable with copper and being welded to the open end of the anode cylinder in airtight fashion in such a manner that the welded mass covers the outer peripheral edge of the flange thereby defining a region in which a pole piece is welded to the flange of the cylindrical housing.

15. The magnetron according to claim 14, wherein the plated layer is nickel and the welded mass is formed of a nickel-copper alloy which results from the alloying of the nickel plated layer with the copper material of the anode cylinder.

16. The magnetron anode according to claim 14, wherein the plated layer is silver and the welded mass is formed of a silver-copper alloy which results from the alloying of the silver plated layer with the copper material of the anode cylinder.

17. The magnetron anode according to claim 14, wherein the anode cylinder is prepared from at least one selected from the group consisting of copper and copper-containing alloys.

18. The magnetron anode according to claim 14, wherein the anode cylinder is flat plate containing copper which is folded into a hollow cylindrical form, the joint of the mutually facing ends of said folded plate being brazed.

19. The magnetron according to claim 18, wherein a brazing material is an alloy containing less than 70% by weight of silver.

20. The magnetron anode according to claim 18, wherein the brazing material seeps into the region in which the pole piece is welded to the flange of the cylindrical housing.

* * * * *